United States Patent [19]

Morris

[11] 4,006,572

[45] Feb. 8, 1977

[54] SECURITY FRAME AND MIRROR ASSEMBLY

[75] Inventor: Earl L. Morris, Whittier, Calif.

[73] Assignee: Acorn Engineering Company, Industry, Calif.

[22] Filed: Nov. 13, 1975

[21] Appl. No.: 631,448

[52] U.S. Cl. ..... 52/506; 40/152.1; 52/475; 248/466

[51] Int. Cl.[2] ..... A47G 1/16; E04B 1/38

[58] Field of Search ..... 52/506, 474, 475, 476, 52/633; 248/466, 489, 495; 40/152.1; 109/51

[56] References Cited

UNITED STATES PATENTS

| | | | |
|---|---|---|---|
| 1,365,918 | 1/1921 | Jaeger | 109/51 X |
| 1,908,147 | 5/1933 | Hoegger | 248/489 |
| 2,577,661 | 12/1951 | Laystrom et al. | 248/466 |
| 2,928,199 | 3/1960 | Novak | 40/152.1 |
| 3,597,586 | 8/1971 | Rebovich | 248/466 |
| 3,597,869 | 8/1971 | Ruyle | 40/152.1 |
| 3,668,798 | 6/1972 | Mehl | 40/152.1 |

*Primary Examiner*—J. Karl Bell
*Attorney, Agent, or Firm*—Ben E. Lofstedt

[57] ABSTRACT

A security frame and mirror assembly for mounting to a wall, including a frame with a sidewall and a flange thereabout, a plurality of threaded receptacles secured to the rear face of the flange, a mirror nested between the receptacles and the flange, and threaded rods having one end secured to the threaded receptacles and the other end engaged with the mounting wall.

14 Claims, 4 Drawing Figures

SECURITY FRAME AND MIRROR ASSEMBLY

BACKGROUND OF THE INVENTION:

1. Field of the Invention:

The present invention relates to a security frame and mirror assembly for penal institutions and the like.

2. Description of the Prior Art:

Over the years, significant and expensive problems have been encountered with frame and mirror assemblies used in areas such as public toilet facilities, where the general public has free accesss thereto, and also in public institutions, such as penal and mental institutions. In such areas, replacement of mirrors which become lost or destroyed through theft, damage and defacing represents substantial costs in terms of both replacement of the frame and mirror assemblies themselves and the labor necessary to implement such replacement and reinstallation.

Various types of theftproof frame and mirror assemblies have been proposed, and while these have been useful in terms of their intended purpose, they have been subject to certain objections; such as, for example, the necessity of employing special tools, keys and the like for mounting the frame and mirror assembly to the wall. In other arrangements where latch elements are employed to secure the frame assembly to the wall, it has been found that the construction and arrangement of the latch assemblies are such that the latch assemblies may be destroyed to facilitate and effect the removal of the frame and mirror assembly.

In addition, frame assemblies found in the prior art have not been adaptable to cover the full range of mirror assemblies such as highly polished metal mirrors, tempered glass mirrors, and plexiglas/metal (foil) deposited combination mirrors.

Another problem frequently presented by prior art assemblies is that these assemblies fail to incorporate means for preventing moisture-caused de-silvering of the conventional silvered mirror when these mirrors are mounted to the wall in such security-type frames.

A related problem occuring with prior art devices is that these assemblies fail to effect a moisture seal between the mirror and the frame to prevent liquids from accumulating between the mounting wall, the mirror and the frame. Should this occur, damage to the wall will result along with the frequently-encountered desilvering of the mirror.

Yet still another problem created by prior art frame and mirror assemblies of the type characterized herein is that the peripheral engagment of the frame with the mirror facilitates the ease by which mirrors constructed of relatively fracturable materials, such as glass, may be broken.

After considerable time, research and experimentation, a theftproof and rugged frame and mirror assembly, comprising the present invention, has been devised to overcome the disadvantages experienced in such previously-employed security frame and mirror assemblies.

SUMMARY OF THE INVENTION AND OBJECTS

Fundamentally, the present invention relates to a security frame and mirror assembly for mounting to a wall, comprising a frame means including a sidewall with a flange thereabout, receptacle means secured about the rear face of said flange, mirror means adapted to be nested between said receptacle means and the free edge of said flange; and anchoring means for securing said receptacle means to said mounting wall.

One primary and important object of the present invention is to provide a theftproof frame and mirror assembly mountable to a wall.

Another important and significant object of the present invention is to provide a frame and mirror assembly which cannot be removed from the user's side of the wall to which the frame and mirror assembly is mounted.

A yet still further object of the instant invention is to provide a frame and mirror assembly which significantly reduces the opportunity for edge related fractures when glass mirrors are utilized in the frame and mirror assembly of the present invention.

A further important and primary object of the present invention is to provide a frame and mirror assembly featuring a dual, peripheral fluid seal thereabout whereby fluids are prevented from passing between the front face of the mirror means and the rim of the flange of the frame means and also from passing between the rear face of the mirror means and the mounting wall to which it is abuttingly engaged.

Another primary and important feature of the present invention is to provide a frame and mirror assembly which includes a mirror means having backing means covering the rear face of the mirror, the backing means having a thickness at least equal to the distance between the mounting wall and the rear face of the mirror for maintaining the spacing between the mirror relative to the wall even when the front face of the mirror is placed under rearwardly-directed loading.

Another important object of the present invention is to provide means for limiting the area within which the mirror means may be moved following attachment to the frame means to the mounting wall.

These and other objects, features and many of the attendant advantages of this invention will be appreciated more readily as the subject invention becomes better understood by reference to the following detailed description, when considered in connection with the accompanying drawings, wherein like parts in each of the several Figures are identified by the same reference character.

Figure 1:
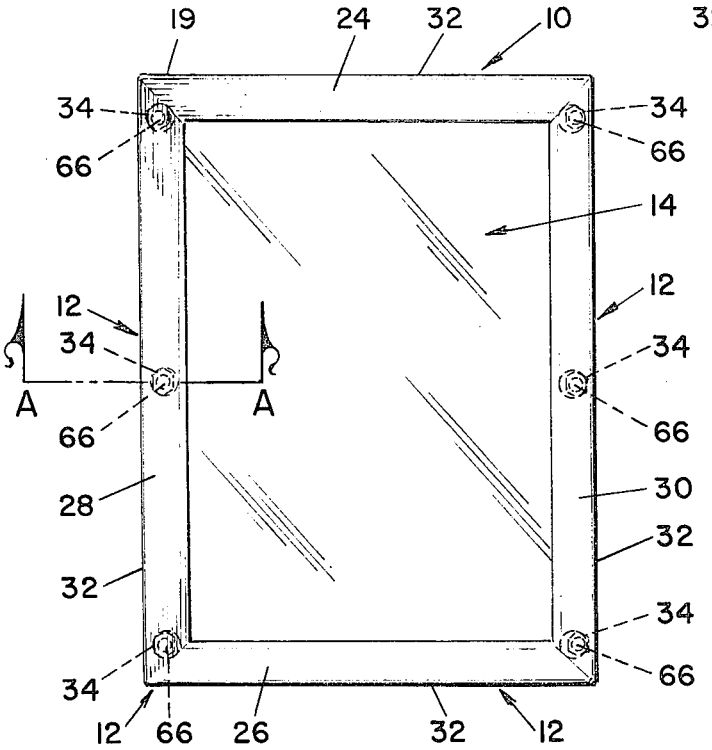
FIG. 1 is a front elevational view of the present invention.
Figure 2:
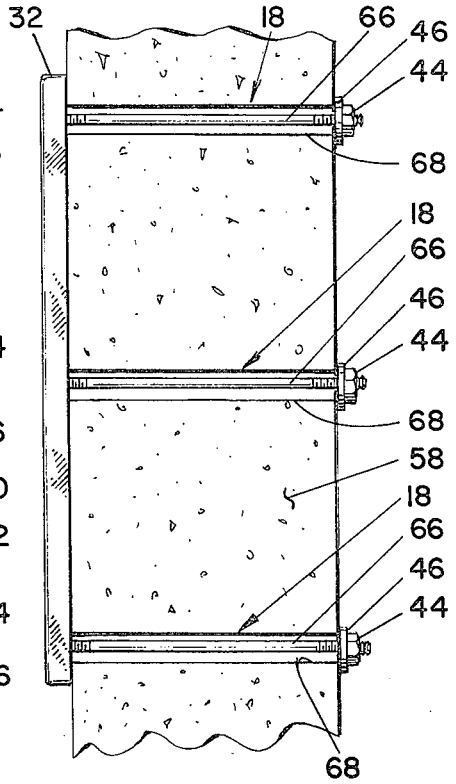
FIG. 2 is a side elevational view of the present invention mounted to a wall.

DESCRIPTION OF THE PREFERRED EMBODIMENT OF THE INVENTION:

With continuing reference to the drawings and more particularly now to FIGS. 1 and 2, an embodiment of the present invention is illustrated which comprises frame means, indicated generally at 10, receptacle means, generally indicated at 12, mirror means, indicated generally at 14, and anchoring means generally indicated at 18. Preferably speaking, the present invention, while not dependent upon such, should also include fluid sealing means generally indicated at 16.

Figure 3:
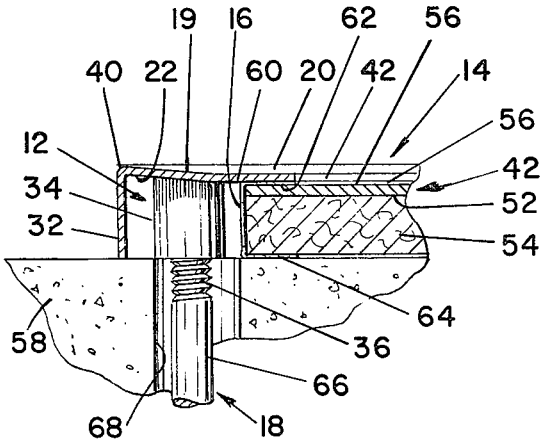
FIG. 3 is an enlarged, sectional, side elevational view of one embodiment of the present invention taken along plane A — A of FIG. 1.

With particular emphasis now on FIGS. 1, 2 and 3, the frame means 10, in this preferred embodiment, includes a rectangular flange 19 having a front facing surface 20 and a rear facing surface 22, and a pair of upper and lower members 24, 26 connected to side members 28, 30. The end members 24, 26 and side members 28, 30 are turned rearwardly at their outer edges to provide a continuous sidewall 32 thereabout. As clearly depicted in FIG. 3, the flange 19, from its outer edge 40 to its inner edge 42, slopes slightly rearwardly, the purpose of which will be more fully explained as the description of the present invention proceeds herein.

It should be noted at this time that the frame means 10, in order to withstand substantial abuse, is typically constructed of rugged stainless steel sheetmetal. The finish of the stainless steel sheetmetal is typically of the brushed type which imparts the desired visual and finished qualities to the frame means 10. The end result is a rugged frame having excellent visual qualities.

Figure 4:
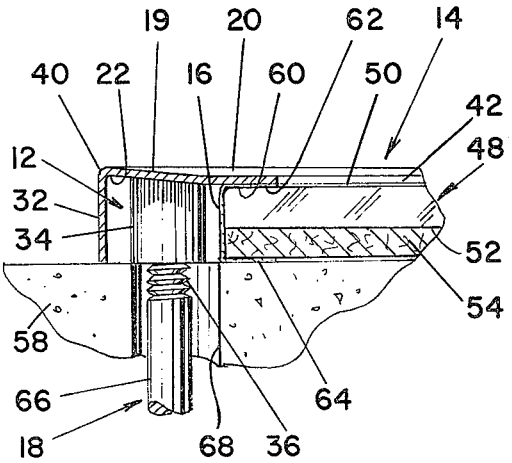
FIG. 4 is an enlarged, sectional side elevational view of another embodiment of the present invention taken along Plane A — A of FIG. 1.

Referring now more specifically to FIGS. 1, 3 and 4, there is shown receptacle means 12, which comprises in this particular embodiment, a plurality of cylindrical posts 34 which are drilled and threaded at one end to receive the anchoring means 18, shown in this preferred embodiment as a plurality of threaded rods 66, correspondingly threaded at 36 to matingly engage the threaded cylindrical posts 34. The opposite ends of the posts 34 are compression welded to the rear facing surface 22 of the flange 19, thereby securely bonding the posts 34 to the frame means 10. Typically, the opposite ends of the anchoring means 18 are also threaded for threadable engagement with a nut 44 which is directed into intimate abuttment with a washer 46 passed over the end of the anchoring means 18 prior to the threaded engagement with the nut 44. A more complete understanding of the function and purpose of the anchoring means 18, the nut 44 and the washer 46 will be obtained as the description of the invention and its use continues hereinafterwards.

The mirror means 14 includes a mirror including a front facing surface 50 and a rear facing surface 52 and a backing means 54 covering the entire rearwardly facing surface 52 of the mirror 48. As desired, the mirror may be selected from a number of durable mirror types having varying degrees of suitability for a particular use, which, in turn, of course, is dependent upon the degree of security needed. Suitable mirror types for use in public institutions are as follows. Highly polished, metal mirrors made of 20 gauge, cold rolled steel are certainly suitable. Such mirrors are first machine polished, then copper plated to form a uniform and highly electrically conductive surface thereon suitable for electric plating, and finally chrome plated. While the reflective quality and scratch resistance of this type of metal mirror is far superior to stainless steel which has been polished to a mirror finish, it is not truly equivalent to that of plate glass mirrors. Such a metal mirror is shown in FIG. 3 and is identified as 56.

Another mirror type suitable for security use is a Plexiglas mirror, typically having quarter-inch thickness. Plexiglas is almost unbreakable, having about fourteen times the strength of glass. The reflective qualities are excellent; however, the surface is subject to scratching, and care must be used when cleaning.

One of the most desirable and frequently used mirrors is that constructed of quarter inch thick tempered glass. Tempered glass has four to five times the strength of comparable plate glass. It is extremely difficult to break and, if broken, the mirror will crumble into small, rounded crystals having substantially reduced cutting capability.

The mirror 48 is sized to completely cover the opening defined by the inner edge 42 of the flange 19, and yet is nestable within the locus defined by the plurality of posts 34 which form the receptacle means 12.

The backing means 54, as previously described, covers the entire rearwardly facing surface 52 of the mirror 48. The thickness of the backing means 54 is determined by the distance between the rearwardly facing surface 52 of the mirror 48 and the wall 58 to which the frame means 10 is mounted. The function of the backing means 54 is to fill this space and to bridge this distance.

The purpose of such backing means 54 is to provide a means for spacing the mirror 48 away from the mounting wall 58 and to ensure intimate engagement between the rear facing surface 22 of the flange 19 and the peripheral lip 60 of the front facing surface 50 of the mirror 48 defined between the outside peripheral edge of the mirror 48 and the inner edge 42 of the flange 19. Such backing means 54 is typically constructed from sheets of dense pressed wood fibers, such a chip board or Masonite.

A fluid sealing means 16, normally comprising a waterproof adhesive tape, is bonded about the outside peripheral edge of the mirror 48 and forms a pair of lips 62, 64. Lip 62 is bonded to the peripheral lip 60 of the mirror 48 and is sandwiched inbetween the rear facing surface 22 of the flange 19 and the lip 60 of the mirror 48 to form a water tight seal when brought into such aforementioned intimate abutting relationship. Such a fluid seal is necessary to prevent fluids, and more particularly liquids such as water, from seeping into the chamber defined by the flange 19, the sidewall 32, and the outer peripheral edge of the mirror means 14 and the mounting wall 58. When water seeps into this chamber, the moisture creates many problems, among the greatest of which is the de-silvering of the mirror and the associated problems thereof.

The construction of the frame and mirror assembly of the present invention is such that when mounted to a wall, it cannot be removed from the mirror user's side of the wall, thereby rendering the frame and mirror assembly truly theftproof.

While many building constructions have walls the backsides of which are not accessible, many institutions employ pipe or utility chases which permit the backsides of such walls to be accessible in such a manner as to welcome the use of such backside anchored units such as the present invention.

The present invention is mounted to the wall 58 in the following fashion. The mounting wall 58 is prepared by boring six holes 68 therethrough (only three of which are shown in FIG. 2; the remaining three are located directly behind the three shown in FIG. 2 and hence are not shown), the pattern of which is aligned with the threaded bores of the posts 34. The frame means 10 and the mirror means 14 are mated, and the posts 34 are aligned with the holes 68 in the mounting wall 58. The ends of the threaded rods 66 are each passed into the holes 68 in the mounting wall 58 and threadably mated to a post 34. The opposite threaded end of each rod 66 now projects beyond the rear face of the mounting wall 58. A washer 46, sufficiently large to bridge the hole 68 in the mounting wall 58 is passed over the end of the rods 66. A nut 44 is then threadably mated with each of the rod 66 ends and tightened so as to bring the rearwardmost edge of the sidewall 32 into intimate engagement with the mounting wall 58 and to effect a fluid seal between the flange 19 and the fluid sealing means 16 hereinbefore described.

As previously described and noted and clearly shown in FIGS. 3 and 4 of the drawings, the end members 24, 26 and side members 28, 30 forming the flange 19 are arranged to slope slightly rearwardly from the outer edge 40 to the inner edge 42 thereof. As a result of this slope, the abutting engagement between the front facing surface 50 of the mirror 48 and the rear facing surface 50 of the flange 19, with the lip 62 of the sealing means 16 sandwiched inbetween, is distributed over a relatively broad area of the mirror, effectuating a clamping arrangement between the flange 19 and the mounting wall 58 so as to hold the mirror means 14 in position in such a manner which is not primarily associated with the outer edge of the mirror 48. Consequently, when a glass type mirror is employed with the frame means 10 which is prone to crack under sharp blows inflicted to the edge thereof, the cracking force of such blows are distributed over a wider area and which is also located away from the outer edge of the mirror 48 and, as a result, the mirror is less prone to such cracking.

While only a preferred embodiment of the invention has been disclosed, it will be readily apparent that certain variations in the same can be made without departing from the spirit of the invention, and it is, therefore, to be understood that the invention is not to be limited to the same, but only by the scope of the appended claims.

Having now described my invention, what I claim as new and desire to secure by Letters Patent of the United States of America, is:

1. A security frame and mirror assembly for mounting to a wall, comprising:

a. frame means including a sidewall with a flange thereabout;

b. receptacle means secured directly to the back face of said flange;

c. mirror means adpated to be nested between said receptacle means and the free edge of said flange; and d. anchoring means passed through the mounting wall for securing said receptacle means to said wall, whereby the anchoring means is not accessible, and, consequently, is not removable from the side of the wall to which the frame means, mirror means and receptacle means are mounted.

2. The assembly of claim 1, wherein said flange is directed radially inwardly from the sidewall and rearwardly from its connection with said sidewall so as to place only the peripheral edge of said flange in intimate contact with the mirror means.

3. The assembly of claim 1, wherein said frame means having a sidewall with a flange thereabout, includes a rectangular frame having a substantially L-shaped cross-section, one leg of said L forming said sidewall for said frame and the other leg forming said flange which projects radially towards the central axis of the opening in said frame.

4. The assembly of claim 3, wherein said flange is directed rearwardly from said flange's connection with said sidewall so as to place only the peripheral edge of said flange in intimate contact with the mirror means.

5. The assembly of claim 3, wherein said mirror means is rectangular in shape.

6. A security frame and mirror assembly for mounting to a wall, comprising:

a. frame means including a sidewall with a flange thereabout;

b. receptacle means secured about the back face of said flange, said receptacle means includes a plurality of spaced-apart posts being substantially equal in length to the width of said sidewall, one end of said posts being bonded to said back face of said flange and the other end of said posts having a threaded bore therein;

c. mirror means adapted to be nested between said receptacle means and the free end of said flange; and d. anchoring means for securing said receptacle means to said wall.

7. The assembly of claim 6, wherein said anchoring means comprises:

a. a plurality of threaded rods, disposed in said wall and projecting therebeyond, one end of which is threadably secured to said threaded bore in said posts; and b. a plurality of nuts wherein each nut is threadably mated to the other end of said threaded rods so that as the nut is threadably moved down the length of said rod, said nut engages said wall whereupon further movement theretowards causes said rods to pull said frame sidewalls into intimate abuttment with said wall.

8. The assembly of claim 1, further comprising fluid sealing means disposed about the edge of said mirror means and overlapping onto the front face and the rear face of said mirror adjacent said edge to form a pair of lips thereabout, whereby when said mirror means is nested between said receptacle means, said lip on said front face engages said rear face of said flange in fluid sealing relationship and when said frame is mounted on said wall, said lip on said rear face of said mirror means engages said wall in fluid sealing relationship.

9. The assembly of claim 1, wherein said mirror means comprises:

a. a sheetmetal mirror forming the front face of said mirror means; and b. backing means covering the rear face of said sheetmetal mirror and bonded thereto to form the rear face of said mirror means, said backing means having a thickness at least equal to the distance between said wall to which said frame is mounted and said sheetmetal mirror.

10. The assembly of claim 1, wherein said mirror means comprises:

a. a tempered glass mirror forming the front face of said mirror means; and b. backing means covering the rear face of said tempered glass mirror and bonded thereto to form the rear face of said mirror means, said backing means having a thickness at least equal to the distance between said wall to which said frame is mounted and said tempered glass mirror.

11. The assembly of claim 1, wherein said mirror means comprises:

a. a sheet of plexiglas forming the front face of said mirror means;

b. a metallic layer deposited on the rear face of said plexiglas sheet to form a mirror; and c. backing means covering said metallic layer and bonded thereto to form the rear face of said mirror means, said backing means having a thickness at least equal to the distance between said wall to which said frame is mounted and said metallic layer on said plexiglas sheet.

12. A security frame and mirror assembly for mounting to a wall, comprising:

a. a rectangular frame having a substantially L-shaped cross-section, one leg of said L forming a sidewall for said frame the edge of which is directed rearwardly towards said mounting wall and the other leg forming a flange projecting inwardly towards the center of said frame and sloping rearwardly from its connection to said sidewall towards said mounting wall;

b. a plurality of spaced-apart posts substantially equal in length to the width of said sidewall, one end of said posts being bonded to the back face of said flange and the other end of said posts having a threaded bore therein;

c. a mirror the periphery of which lies between the edge of said flange and said posts;

d. backing means covering the rear face of said mirror and bonded thereto, said backing means having a thickness at least equal to the distance between said wall to which said frame is mounted and said mirror;

e. fluid sealing means disposed about the edge of said mirror and overlapping onto the front face of said mirror and the rear face of said backing means adjacent said edge thereof to form a pair of lips, whereby when said mirror is nested between said posts, said lip on said front face engages said rear face of said flange in fluid sealing relationship and, when said frame is mounted to said wall, said lip on said rear face of said backing means engages said wall in fluid sealing relationship;

f. a plurality of threaded rods disposed in said wall and projecting therebeyond, one end of which is threadably secured to said threaded bore in said posts; and g. a plurality of nuts wherein each nut is threadably mated to the other end of said threaded rods so that as the nut is threadably moved down the length of said rod, said nut engages said mounting wall whereupon further movement theretowards causes said rods to pull said edges of said sidewalls into intimate abuttment with said wall.

13. The assembly of claim 1, wherein said receptacle means comprises a plurality of spaced-apart posts being substantially equal in length to the width of said sidewall, one end of said posts being bonded to said back face of said flange and the other end of said posts having a threaded bore therein.

14. The assembly of claim 13, wherein said anchoring means comprises:

a. a plurality of threaded rods, disposed in said wall and projecting therebeyond, one end of which is threadably secured to said threaded bore in said posts; and b. a plurality of nuts wherein each nut is threadably mated to the other end of said threaded rods so that as the nut is threadably moved down the length of said rod, said nut engages said wall whereupon further movement theretowards causes said rods to pull said frame sidewalls into intimate abuttment with said wall.

* * * * *